US008489002B2

(12) United States Patent
Amann et al.

(10) Patent No.: US 8,489,002 B2
(45) Date of Patent: Jul. 16, 2013

(54) METHOD FOR DELAYING THE START OF A GAGE FOR TRACKING THE LIFE OF A CONSUMABLE ITEM FOR AN IMAGING DEVICE

(75) Inventors: Mark William Amann, Lexington, KY (US); Alan Stirling Campbell, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 264 days.

(21) Appl. No.: 12/858,550

(22) Filed: Aug. 18, 2010

(65) Prior Publication Data

US 2012/0045224 A1 Feb. 23, 2012

(51) Int. Cl.
*G03G 15/08* (2006.01)

(52) U.S. Cl.
USPC ..... 399/260; 399/27; 399/262

(58) Field of Classification Search
USPC ..... 399/27–29, 258, 260, 262
See application file for complete search history.

(56) References Cited

U.S. PATENT DOCUMENTS

2004/0105689 A1* 6/2004 Shimura et al. ..... 399/12

* cited by examiner

*Primary Examiner* — Joseph S Wong
(74) *Attorney, Agent, or Firm* — Justin M Tromp

(57) ABSTRACT

A method for delaying the start of a gage for tracking the life of a consumable item for an imaging device according to one exemplary embodiment includes counting the number of revolutions of a rotating imaging component having a correlation with the life of the consumable item and determining whether a predetermined delay threshold is satisfied based on the number of revolutions of the imaging component counted. Until the predetermined delay threshold is satisfied, starting the gage and tracking the remaining life of the consumable item are delayed.

9 Claims, 4 Drawing Sheets

METHOD FOR DELAYING THE START OF A GAGE FOR TRACKING THE LIFE OF A CONSUMABLE ITEM FOR AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to an imaging device, and more specifically to a method for delaying the start of a gage for tracking the life of a consumable item for an imaging device.

2. Description of the Related Art

Conventional imaging devices may include one or more gages for tracking the life of a consumable item. For example, some devices include a toner gage that tracks an amount of toner remaining in a toner cartridge. The toner gage may display an estimate of the amount of toner remaining to a user on a display device. Before a toner cartridge is shipped to a customer, it may undergo functional testing to ensure proper performance. The toner cartridge may include extra toner to account for the toner that is consumed during the testing process. This ensures that the proper amount of toner remains in the cartridge even after testing is completed. When testing is performed on the toner cartridge, the toner gage functions just as it would during normal operation. In some instances, the testing process may cause the toner gage may read less than 100% when the cartridge is delivered to the customer. However, because extra toner has been added to account for the toner consumed during testing, the cartridge contains at least the required amount of toner to meet yield criteria. But the customer may believe that the cartridge contains less than a "full" amount of toner because the gage reads less than 100%.

In order to account for the extra toner that is added for testing purposes, some conventional imaging devices delay the onset of the toner gage by an assumed amount of toner that must be consumed prior to starting the gage. The imaging device counts the number of pixels printed by each cartridge and multiplies the number of pixels by a constant to convert to an amount of toner consumed. This amount is then compared with a delay threshold. When the amount of toner exceeds the delay threshold, the gage begins. However, some imaging devices must undergo more testing than others. For instance, one imaging device may show a defect and require repair and additional testing while another imaging device may not show any defects and therefore require only one round of testing. In order to account for the potential of additional testing, the delay threshold is set to account for the maximum amount of testing that an imaging device may endure in order to ensure that the toner gage does not begin until testing is complete. Most toner cartridges do not require maximum testing. As a result, most toner cartridges are delivered to the customer with excess toner, the delay threshold unmet, and, as a result, the toner gage not started. The customer's toner use must then satisfy the delay threshold in order to start the toner gage.

A problem with this approach may arise when a customer prints in modes that do not consume much toner, for example spot color. In these modes, very few pixels of a given color are printed on each page, although a small amount of toner is consumed through inefficiencies of the imaging process. In extreme cases, it may be possible for these inefficiencies to empty the toner cartridge before enough pixels are printed to meet the delay threshold thereby emptying the cartridge while the toner gage still reads "FULL." Given the foregoing, it will be appreciated by those skilled in the art that a method for delaying the start of a gage for tracking the life of a consumable item in print modes that use small amounts of toner is desired.

SUMMARY OF THE INVENTION

A method for delaying the start of a gage for tracking the life of a consumable item for an imaging device according to one exemplary embodiment includes counting the number of revolutions of a rotating imaging component having a correlation with the life of the consumable item and determining whether a predetermined delay threshold is satisfied based on the number of revolutions of the imaging component counted. Until the predetermined delay threshold is satisfied, starting the gage and tracking the remaining life of the consumable item are delayed. When the predetermined delay threshold is satisfied, the gage is started and tracking the remaining life of the consumable item begins.

In some embodiments, the rotating imaging component is a pick roller, a transport roller, a toner paddle, a toner metering bar, a toner adder roll, a developer roll, a photoconductor drum, a charging roll, a fusing roll, a backup roll, or an intermediate transfer roller. Embodiments include those wherein the consumable item tracked is a photoconductor drum. Alternatives include those wherein the consumable item tracked is an amount of toner remaining in a toner cartridge.

In some embodiments, the number of revolutions of the imaging component counted is converted to an estimated amount of toner consumed. In such embodiments, determining whether the predetermined delay threshold is satisfied may include determining whether the estimated amount of toner consumed exceeds the predetermined delay threshold.

Embodiments include those wherein the predetermined delay threshold is stored in a non-volatile memory in at least one of the imaging device, an imaging unit or a toner cartridge.

A method for delaying the start of a gage for tracking the life of a consumable item for an imaging device according to another exemplary embodiment includes monitoring a plurality of conditions, each having a correlation with the life of the consumable item, and determining whether the plurality of conditions monitored satisfy at least one predetermined delay threshold. Until the predetermined delay threshold is satisfied, starting the gage and tracking the remaining life of the consumable item are delayed. When the predetermined delay threshold is satisfied, the gage is started and tracking the remaining life of the consumable item begins.

In some embodiments, the consumable item tracked is a photoconductor drum. Alternatives include those wherein the consumable item tracked is an amount of toner remaining in a toner cartridge.

In some embodiments, monitoring the plurality of conditions includes counting the number of revolutions of a rotating imaging component and counting the number of pixels printed by a toner cartridge. In some embodiments, the rotating imaging component is a pick roller, a transport roller, a toner paddle, a toner metering bar, a toner adder roll, a developer roll, a photoconductor drum, a charging roll, a fusing roll, a fusing belt, a backup roll, an intermediate transfer roller or an intermediate transfer belt.

Embodiments include those wherein the predetermined delay threshold is satisfied when one of the plurality of conditions monitored exceeds the predetermined delay threshold.

In some embodiments, determining whether the predetermined delay threshold is satisfied includes determining whether the number of revolutions of the imaging component counted exceeds a first threshold and whether the number of pixels counted exceeds a second threshold. Further embodiments include those wherein the predetermined delay threshold is satisfied when either the number of revolutions of the imaging component counted exceeds the first threshold or the number of pixels counted exceeds the second threshold.

A method for delaying the start of a gage for tracking the life of a consumable item for an imaging device according to one exemplary embodiment includes counting the number of pages printed by the imaging device and determining whether the number of pages counted satisfies a predetermined delay threshold. Until the predetermined delay threshold is satisfied, starting the gage and tracking the remaining life of the consumable item are delayed. When the predetermined delay threshold is satisfied, the gage starts and tracking the remaining life of the consumable item begins. In some embodiments, the consumable item tracked is a photoconductor drum or an amount of toner remaining in a toner cartridge.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
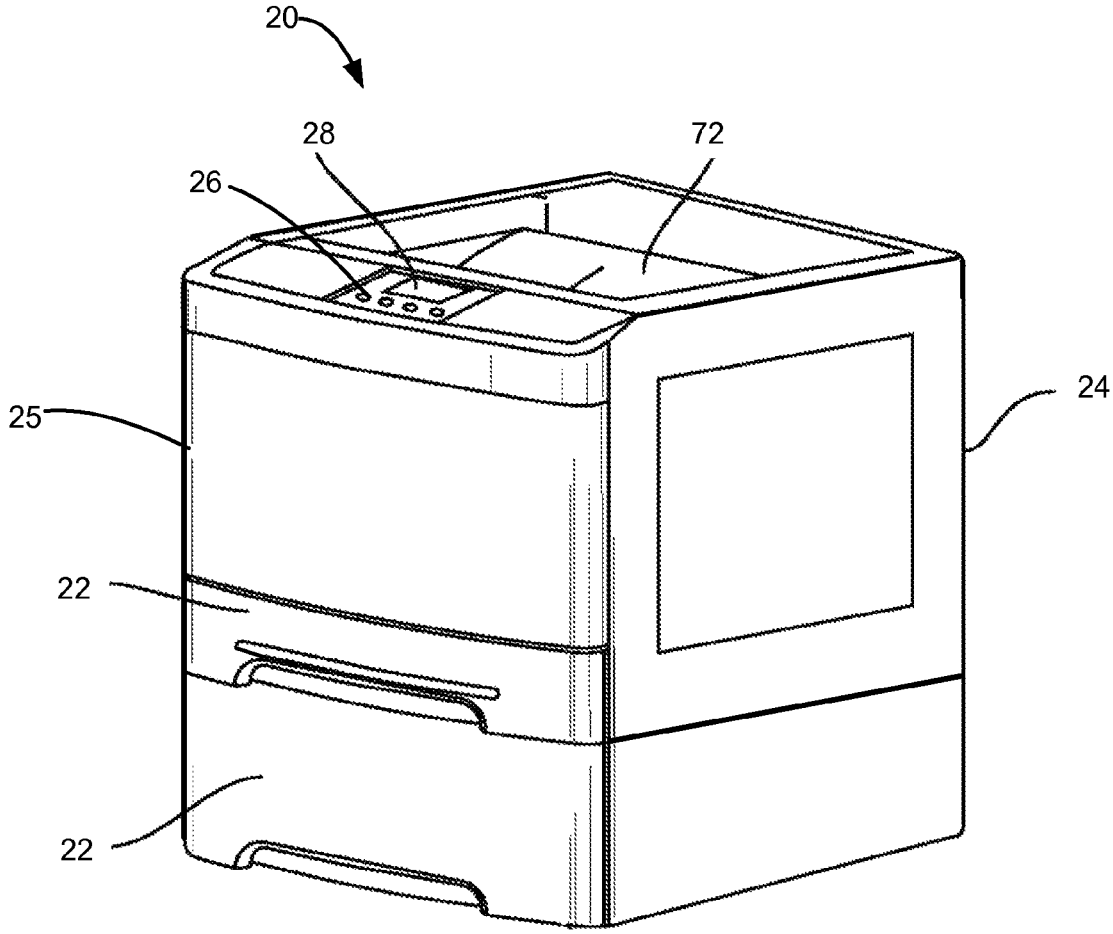
FIG. 1 is a perspective view of an imaging device according to one embodiment.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

FIG. 1 illustrates an exemplary embodiment of an imaging device 20. The device 20 includes one or more input trays 22 positioned in a section of a body 24. The trays 22 are sized to contain a stack of media sheets that will receive color and/or monochrome images. The trays 22 are preferably removable for refilling. A control panel 26 may be located on the front 25 of the body 24. Using the control panel 26, the user is able to enter commands and generally control the operation of the imaging device 20. For example, the user may enter commands to switch modes (e.g., color mode, monochrome mode), view the number of images printed, etc. The control panel may include a display device 28 thereon.

Figure 2:
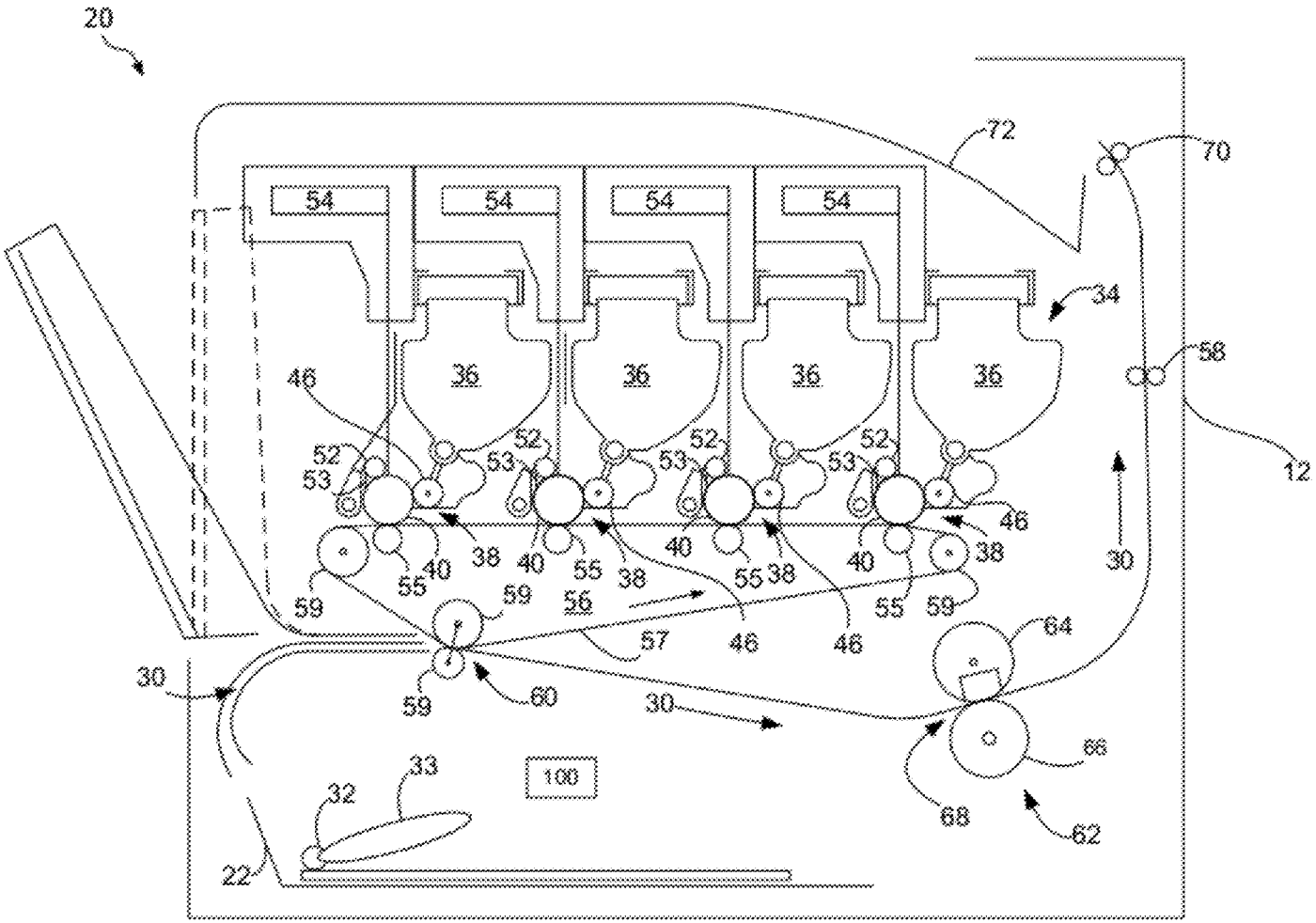
FIG. 2 is schematic cross-sectional view of an imaging device according to one embodiment.

With reference to FIG. 2, a media path 30 extends through the imaging device 20 for moving the media sheets through the imaging process. A media sheet is initially introduced into the media path 30 from the tray 22 by a pick roller 32. In the exemplary embodiment shown, the pick roller 32 comprises a roll positioned at the end of a pivotable arm 33. The roll rotates to move the media sheet from the tray 22 and into the media path 30. The media sheet is then moved along the media path 30 by transport rollers 58.

The device 20 includes one or more imaging stations 34. Each imaging station 34 includes a toner cartridge 36 and an imaging unit 38. In some embodiments, the toner cartridge 36 and the imaging unit 38 comprise a single unit. Alternatives include those wherein the toner cartridge 36 and the imaging unit 38 comprise multiple units that are operatively connected to one another. Each of the imaging stations 34 is mounted such that photoconductor (PC) drums 40 of the imaging stations 34 are substantially parallel. In one embodiment, each of the imaging stations 34 is substantially the same except for the color of toner stored and transferred.

Figure 3:
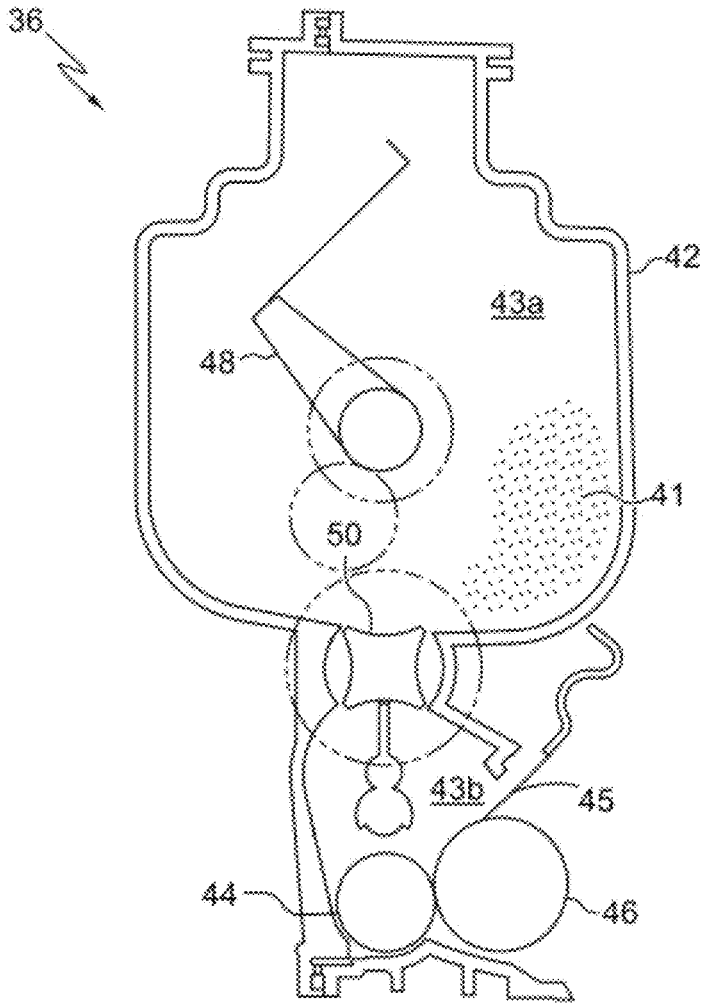
FIG. 3 is a cross-sectional view of a toner cartridge according to one embodiment.

With reference to FIG. 3, the toner cartridge 36 includes a toner reservoir 42 to contain the toner 41, a toner adder roll 44, a doctor blade 45 and a developer roll 46. The toner reservoir 42 may be divided into an upper sump area 43*a* and a lower sump area 43*b*. An agitating toner paddle 48 may be positioned within the upper sump area 43*a* to move the toner within the reservoir 42. A toner metering bar 50 is configured to transfer a predetermined amount of toner per rotation from the upper sump area 43*a* to the lower sump area 43*b*. The toner adder roll 44 coats the developer roll 46 with toner while electrostatically charging the toner particles. As the toner is placed on the developer roll 46, the doctor blade 45 evens the toner to a predetermined thickness. In one embodiment, the toner reservoirs 42 each contain one of black, magenta, cyan, or yellow toner. In one embodiment, each of the toner reservoirs 42 is substantially the same. In another embodiment, the toner reservoirs 42 include different capacities.

With reference back to FIG. 2, each imaging unit 38 includes a charging roll 52, a PC drum 40 and a cleaning blade 53. The charging roll 52 forms a nip with the PC drum 40 and charges the surface of the PC drum 40 to a specified voltage. A laser beam from a printhead 54 is directed to the surface of the PC drum 40 and discharges those areas it contacts to form a latent image. The developer roll 46, which also forms a nip with the PC drum 40, then transfers toner to the PC drum 40 to form a toner image. The toner is attracted to the areas of the PC drum 40 surface discharged by the laser beam. The cleaning blade 53 then removes any remaining particles of toner from the PC drum 40 after the toner image is transferred to either the media or an intermediate transfer mechanism.

In the embodiment shown, an intermediate transfer mechanism (ITM) 56 is disposed adjacent to each of the imaging stations 34. In this embodiment, the ITM 56 is formed as an endless belt 57 trained about a series of rollers 59. During image forming operations, the belt 57 moves past the imaging stations 34 as viewed in FIG. 2. One or more of the PC drums 40 apply toner images in their respective colors to the belt 57. In one embodiment, toner transfer rollers 55 positioned beneath belt 57 adjacent each PC drum 40 provide a positive voltage field the attracts the toner image from the PC drums 40 to the surface of moving belt 57. As ITM 56 revolves, belt 57 collects the one or more toner images from the imaging stations 34 at a first transfer area beneath the imaging stations 34 and then conveys the toner images to a media sheet at a second transfer area. The second transfer area includes a transfer nip 60 formed between a pair of rollers 59. Alternative embodiments include those wherein the toner images are applied directly the media sheet by the PC drum(s) 40.

After receiving the toner images, the media sheets are moved further along the media path 30 and into a fuser 62. The fuser 62 includes a fusing roll 64, or belt, and a backup roll 66 that form a fuser nip 68 to apply pressure and or heat to the toner image on the media sheet as it passes through the fuser nip 68. The combination of heat and pressure fuses or adheres the toner image to the media sheet. The fused media sheets then pass through exit rolls 70 that are located downstream from the fuser 62 and into an output bin 72 or through a duplex path (not shown) for duplex printing.

In the embodiment illustrated, the imaging device 20 is a color laser printer. In another embodiment, the imaging device 20 is a mono printer comprising a single toner cartridge 36 and a single imaging unit 38 for forming toner images in a single color. In another embodiment, the imaging device 20 is a direct transfer device that transfers the toner images from the one or more PC drums 40 directly to the media sheet. As used herein, the term media sheet is meant to encompass not only paper but also labels, envelopes, fabrics, photographic paper or any other desired substrate that can receive a toner image.

A controller 100 oversees the functioning of the device 20. Controller 100 may include a microcontroller with associated memory. In one embodiment, controller 100 includes a processor, random access memory, read only memory, and an input/output interface. Controller 100 oversees the functioning of the imaging device 20 including movement of the media along media path 30, imaging station(s) 34, ITM 56, printheads 54, control panel 26 and display 28. Each toner cartridge 36, toner reservoir 42 and/or imaging unit 38 may also contain its own associated memory.

The imaging device 20 includes various consumable items that must be replaced at various times over the life of the imaging device 20. These may include, but are not limited to, for example, each PC drum 40, each toner cartridge 36 and/or the toner 41 stored therein, each toner adder roll 44, each doctor blade 45, each developer roll 46, each charging roll 52 and each cleaner blade 53. The imaging device 20 also includes one or more gages for tracking the remaining life of one or more of these consumable items. For example, the imaging device 20 may include a toner gage that estimates and tracks the amount of toner 41 remaining in one or more toner cartridges 36. In those embodiments that contain multiple toner cartridges 36 and imaging units 38, the imaging device 20 may include a separate gage for each respective consumable item. For example, the imaging device 20 may include separate gages for the amounts of black, cyan, yellow and magenta toner remaining and/or for the PC drums 40 associated with each imaging unit 38.

Figure 4:
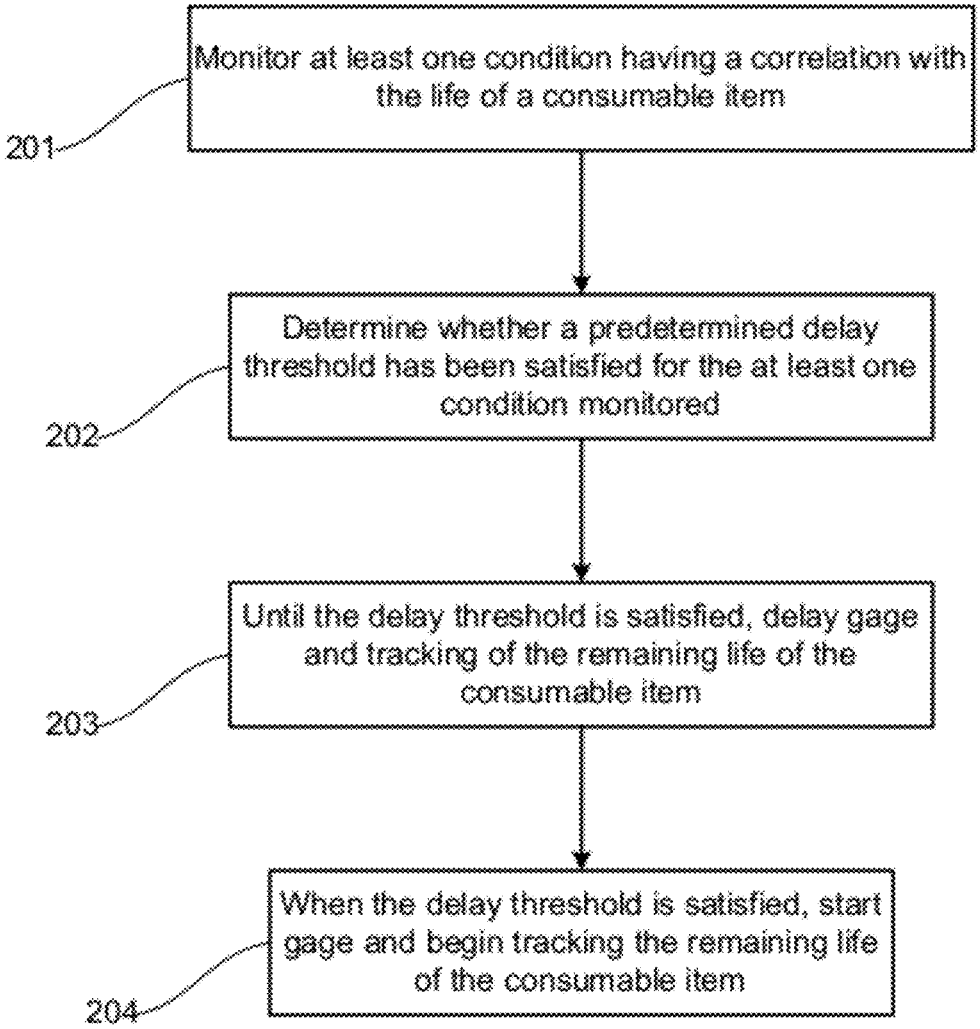
FIG. 4 is a flow chart of a method for delaying the start of a gage for tracking the life of a consumable item for an imaging device according to one embodiment.

With reference to FIG. 4, a method for delaying the start of a gage for tracking the life of a consumable item for the imaging device 20 is shown. Where the imaging device 20 includes multiple gages, the following method may be used to delay one or more of the gages. The method may be utilized in combination such that multiple gages may be delayed and started in unison or the method may be applied separately and independently to each gage. At step 201, the processor monitors a condition associated with the consumable item. In some embodiments, the processor counts the number of revolutions of a rotating imaging component having a correlation with the life of the consumable item. As used herein, the term rotating imaging component includes any component disposed within or on an imaging device that rotates and/or revolves. Any suitable rotating imaging component may be used including any component that rotates in response to or during an imaging operation. For example, the rotating component may include a pick roller 32, a transport roller 58, a toner paddle 48, a toner metering bar 50, a toner adder roll 44, a developer roll 46, a PC drum 40, a charging roll 52, an intermediate transfer roller 59, an intermediate transfer belt 57, a backup roll 66, a fusing roll 64 or a fusing belt. As will be appreciated by those skilled in the art, the revolutions of the rotating component may be counted using any suitable method including by tracking the revolutions of a motor that drives the rotating component or by using mechanical or optical sensors or the like. Alternatives include those wherein the controller 100 counts the number of pages printed by the imaging device 20. In the case of duplex printing, the number of pages may be equal to the number of physical media sheets printed. Alternatively, the number of pages may be equal to the number of sides of media sheets that are printed; it being understood that a media sheet that has undergone duplex printing may contain an image on both sides of the sheet and therefore count as two pages. In those imaging devices 20 that contain multiple toner cartridges 36, such as those that contain a separate toner cartridge 36 for black, cyan, magenta and yellow toner, and that utilize a separate gage for each color, for purposes of each gage, embodiments include those wherein a page is counted only if it contains the color corresponding with such gage. Alternatives include those wherein the page is counted regardless of whether it contains a specific color so long as the page has received an image. However, those skilled in the art will appreciate that any suitable condition may be monitored in order to delay the start of the gage including the number of revolutions of a rotating component, the number of pixels printed, the number of pages printed, the time elapsed during imaging operation, etc.

At step 202, the controller determines whether a predetermined toner delay threshold has been satisfied based on the condition monitored. For example, in those embodiments utilizing the number of revolutions of an imaging component to delay the gage, the controller determines whether the predetermined toner delay threshold has been satisfied based on the number of revolutions of the imaging component counted. In general, the delay threshold is satisfied when a variable associated with the condition measured exceeds the delay threshold. The term "exceeds" as used herein is meant to encompass both determining whether the measured variable is equal to or greater than (≧) the delay threshold and whether the measured variable is greater than (>) the delay threshold. The delay threshold is selected empirically to ensure that once the value of the condition measured exceeds the threshold, testing of the consumable item is complete. This ensures that the gage associated with the consumable item is not started until after testing is complete.

In some embodiments, the delay threshold and the condition monitored have the same units of measure such that the value of the condition monitored can be compared directly to the threshold without conversion. For example, embodiments include those wherein the delay threshold and the condition measured comprise a number of revolutions such that the number of revolutions of the imaging component counted can be compared directly with the threshold. Alternatives include those wherein the threshold and the value of the condition measured have different units of measurement such that the value measured must be converted. For example, where the consumable item tracked is the amount of toner remaining in the toner cartridge 36, the delay threshold may comprise an amount of toner consumed and the value of the condition measured is converted to an amount of toner consumed. For example, where the number of revolutions of an imaging component is used to delay the gage, the average mass or volume of toner consumed per revolution of the rotating component can be determined empirically. The number of revolutions of the imaging component can then be multiplied by this empirically determined constant to estimate the mass or volume of toner that has been consumed to date thereby permitting comparison with the delay threshold where the delay threshold comprises an amount of toner. In some embodiments, the step of determining whether the delay threshold has been satisfied includes determining whether an estimated amount of toner consumed exceeds the delay threshold.

At step 203, until the delay threshold is satisfied, the gage is delayed and the controller 100 delays tracking the remaining life of the consumable item. At step 204, when the predetermined delay threshold is satisfied, the gage starts and the processor begins tracking the remaining life of the consumable item according to conventional methods.

In some embodiments, multiple variables are used to delay the start of the gage. In such embodiments, the processor monitors a plurality of conditions that have a correlation with the life of the consumable item. Any suitable condition that occurs during or in response to an imaging operation may be used. Embodiments include those where monitoring the plurality of conditions includes counting the number of revolutions of a rotating imaging component and counting the number of pixels printed by a toner cartridge 36. As discussed above, any suitable rotating imaging component may be used including any component that rotates in response to or during an imaging operation such as, for example, the PC drum 40.

Where multiple conditions are monitored, the delay threshold may comprise multiple thresholds. In other words, determining whether the delay threshold has been satisfied may include determining whether a first condition exceeds a first threshold, whether a second condition exceeds a second threshold, etc. For example, in some embodiments, determining whether the delay threshold has been satisfied includes determining whether the number of revolutions of a rotating imaging component exceeds a first threshold and whether the number of pixels printed by a toner cartridge 36 exceeds a second threshold. Upon both thresholds being met the gage starts.

In embodiments where multiple conditions are monitored, the delay threshold may be satisfied when one of the conditions monitored exceeds the delay threshold. For example, in some embodiments, the delay threshold is satisfied when either the number of revolutions of the rotating imaging component exceeds a first threshold or when the number of pixels printed by the toner cartridge 36 exceeds a second threshold. In this example, the number of pixels will generally govern during heavy printing (many pixels per page). Conversely, the number of revolutions of the imaging component will generally govern during light printing (few pixels of a respective color per page). Alternatives include those wherein more than one or all of the conditions monitored must exceed the delay threshold to satisfy the threshold.

In some embodiments, the delay threshold(s) are stored in non-volatile memory in the imaging device 20. Alternatives include those wherein the delay threshold(s) are stored in non-volatile memory of the toner cartridge 36, the toner reservoir 42 or the imaging unit 38. The value of the condition measured may be stored in non-volatile memory in the imaging device 20 or in non-volatile memory of the toner cartridge 36, the toner reservoir 42 or the imaging unit 38 so that the value travels with the cartridge 36, reservoir 42 or unit 38 if such component is transferred to a different imaging device 20. Further, when a new cartridge 36, reservoir 42 or unit 38 is placed in the imaging device 20, the values of the condition (s) measured associated with such component are reset. Also the delay thresholds may change if a new toner is used in the toner cartridge as the relationship between pixel count and toner usage may change or if the amount of testing required changes. For example, when a new imaging unit or imaging device is introduced, the amount of testing will be greater than for a mature imaging unit or imaging device that has been in production for some period of time.

Accordingly, it will be appreciated that the maximum value of a condition having a correlation with the life of a consumable item that occurs from testing of the consumable item can be reasonably estimated. Therefore, a delay threshold can be accurately set so that the gage will start promptly after testing of the consumable item is completed. Further, as the number of revolutions of a rotating component, the number of pages printed and the time elapsed during imaging operation are reasonably correlated with the toner consumed by electrophotographic inefficiencies, the use of one or more of these variables will help ensure that a toner gage will start shortly after testing is complete even in print modes that use very little toner from a respective toner cartridge.

The foregoing description of an embodiment of the invention has been presented for purposes of illustration. It is not intended to be exhaustive or to limit the invention to the precise forms disclosed, and obviously many modifications and variations are possible in light of the above teaching. It is understood that the invention may be practiced in ways other than as specifically set forth herein without departing from the scope and essential characteristics of the invention. It is intended that the scope of the invention be defined by the claims appended hereto.

What is claimed is:

1. In an imaging device, a method for delaying the start of a gage for tracking the life of a consumable item for the imaging device, comprising:

monitoring a plurality of independently determined conditions, each of the plurality of independently determined conditions having a correlation with the life of the consumable item;

determining whether the plurality of independently determined conditions monitored satisfy at least one predetermined delay threshold; and until the predetermined delay threshold is satisfied, delay starting the gage and tracking the remaining life of the consumable item.

2. The method of claim 1, further comprising when the predetermined delay threshold is satisfied, starting the gage and begin tracking the remaining life of the consumable item.

3. The method of claim 1, wherein the consumable item tracked is a photoconductor drum.

4. The method of claim 1, wherein the consumable item tracked is an amount of toner remaining in a toner cartridge.

5. The method of claim 4, wherein monitoring the plurality of independently determined conditions includes counting the number of revolutions of a rotating imaging component and counting the number of pixels printed by a toner cartridge.

6. The method of claim 5, wherein the rotating imaging component is selected from the group consisting of a pick roller, a transport roller, a toner paddle, a toner metering bar, a toner adder roll, a developer roll, a photoconductor drum, a charging roll, a fusing roll, a fusing belt, a backup roll, an intermediate transfer roller and an intermediate transfer belt.

7. The method of claim 5, wherein determining whether the predetermined delay threshold is satisfied includes determining whether the number of revolutions of the imaging component counted exceeds a first threshold and whether the number of pixels counted exceeds a second threshold.

8. The method of claim 7, wherein the predetermined delay threshold is satisfied when either the number of revolutions of the imaging component counted exceeds the first threshold or the number of pixels counted exceeds the second threshold.

9. The method of claim 1, wherein the predetermined delay threshold is satisfied when one of the plurality of independently determined conditions monitored exceeds the predetermined delay threshold.

* * * * *